United States Patent [19]

Seilly

[11] 4,269,361

[45] May 26, 1981

[54] FUEL INJECTION NOZZLES

[75] Inventor: Alec H. Seilly, North Wembley, England

[73] Assignee: Lucas Industries Limited, Birmingham, England

[21] Appl. No.: 90,096

[22] Filed: Nov. 1, 1979

[30] Foreign Application Priority Data

Dec. 9, 1978 [GB] United Kingdom ..... 47872/78

[51] Int. Cl.[3] ..... B05B 1/30

[52] U.S. Cl. ..... 239/585

[58] Field of Search ..... 239/585, 533.3–533.5; 123/32 JV

[56] References Cited

U.S. PATENT DOCUMENTS 3,913,537 10/1975 Ziesche ..... 239/585 X

FOREIGN PATENT DOCUMENTS 2365070 9/1976 France ..... 239/585

*Primary Examiner*—Bruce H. Stoner, Jr.
*Assistant Examiner*—Gene A. Church

[57] ABSTRACT

A fuel injection nozzle includes a spring which loads a fluid pressure operable valve member into contact with a seating. An electromagnetic device including an armature acts when energized to reduce the force exerted by the spring on the valve member to allow the valve member to be lifted from the seating by the fluid pressure. The return motion of the armature when the device is de-energized is effected by the spring and the armature can continue to move after the valve member has engaged the seating. Friction device is provided to damp the continued movement of the armature.

11 Claims, 2 Drawing Figures

FUEL INJECTION NOZZLES

This invention relates to liquid fuel injection nozzles of the kind intended to be mounted on an internal combustion engine and through which liquid fuel can be supplied to the engine, the nozzle comprising a body part, a seating defined in the body part, a valve member shaped for co-operation with said seating, resilient means biasing the valve member into contact with the seating to prevent the flow of liquid fuel through an outlet from an inlet and electro magnetic means which when energised, acts to reduce the force exerted by the resilient means on said valve member so that the valve member can move away from the seating under the action of fuel pressure to permit flow of fuel from the inlet to the outlet.

In such a nozzle the electro magnetic means comprises an armature engageable with a member through which the force exerted by the resilient means is transmitted to the valve member. With this arrangement when the electro magnetic means is de-energised, the armature is returned to its initial position by the action of the resilient means and in so doing gains considerable inertia. In order to minimise the impact loading when the valve member engages the seating it is arranged that the armature can continue to move after the valve member has been brought to rest. It is however, necessary to halt the armature and this can be achieved by means of a spring. The spring will however, store a part of the energy in the moving armature and will reverse the movement of the armature which will then engage with said member. The force of the engagement may be sufficient to allow the valve member to be lifted from its seating resulting in a further flow of fuel through the outlet and this is clearly undesirable.

The object of the present invention is to provide a nozzle of the kind specified in a simple and convenient form.

According to the invention, a nozzle of the kind specified comprises an abutment member engaging the valve member and through which the force exerted by the resilient means acts on the said valve member, an armature forming part of said electro magnetic means, the armature including a portion engageable against said abutment member on the side thereof adjacent the valve member whereby when the electro magnetic means is energised said portion of the armature will engage said abutment member to reduce the force exerted by the resilient means on the valve member and when the electro magnetic means is de-energised the portion of the armature can separate from the abutment member, and friction means operable during separation of said portion of the armature from the abutment member to absorb the energy gained by the armature during its movement under the action of said resilient means.

According to a further feature of the invention said friction means acts between the armature and said abutment member.

Figure 1:
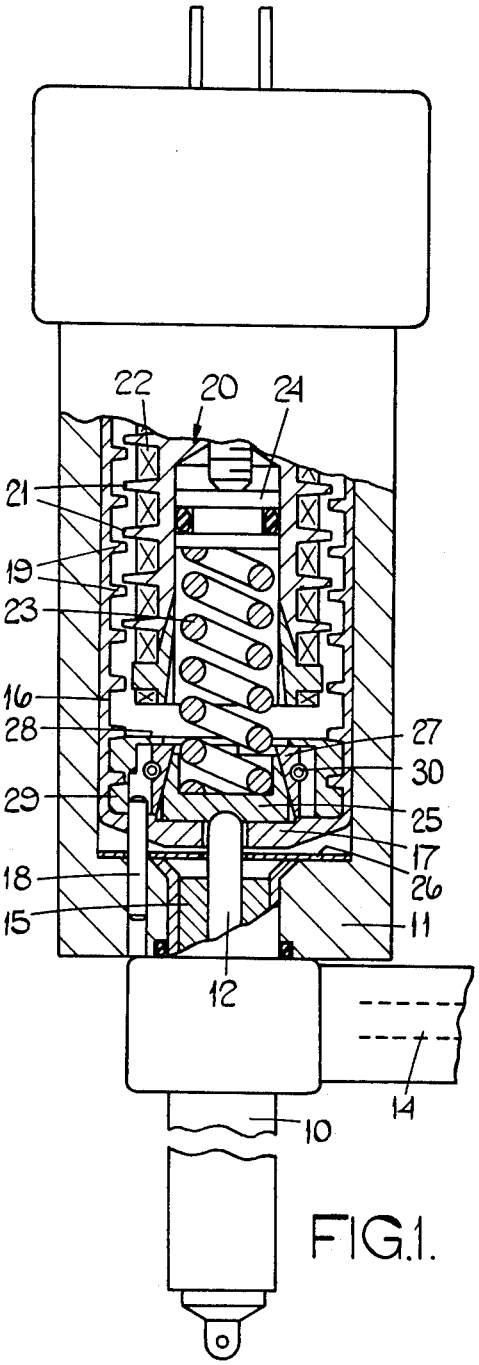
Figure 2:
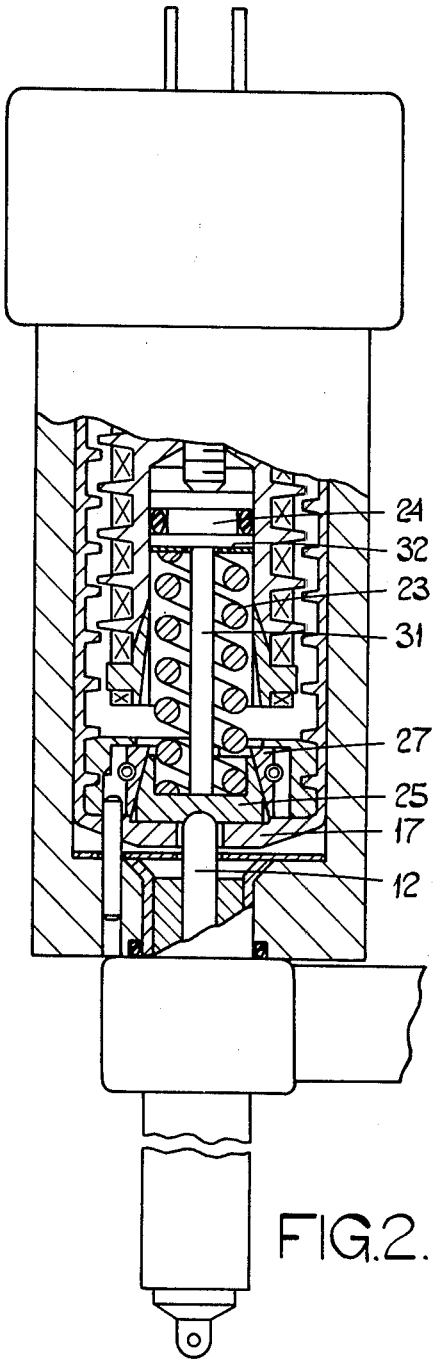

Two examples of injection nozzles in accordance with the invention will now be described with reference to the accompanying drawings, in which FIGS. 1 and 2 show part sectional side elevations of the nozzle.

Referring to FIG. 1 the nozzle comprises a two part body portion, the two portions being assigned the reference numerals 10 and 11. The portion 10 of the body accommodates a conventional valve member the outer end of which is indicated at 12. The valve member as is well known in the art, is of stepped form, and is slidable within a bore which has a seating defined at one end thereof. The valve member is shaped for co-operation with the seating to prevent the flow of fuel through outlet orifices 13 from a fuel inlet 14 which in use, is connected to a source of fuel under pressure. The valve member again as is well known in the art, has a surface against which the fuel under pressure at the inlet can act to lift the valve member from its seating. In use, the body portion 10 is located within a bore in the cylinder head of an engine with the orifices 13 exposed within a combustion space of the engine.

The body portion 11 is located about a spigot 15 defined by the portion 10 and it defines a cylindrical chamber in which is slidable a cup shaped armature 16. The base portion 17 of the armature is provided with an aperture through which extends the end 12 of the valve member and the armature is retained against angular movement within the body portion 11 by means of a guide pin 18.

On the internal peripheral surface of the wall of the armature is formed a two part helical thread which therefore defines two helical ribs which are indicated at 19. Extending into the chamber is a stator structure generally indicated at 20 and which has defined on its outer peripheral surface a pair of helical ribs indicated at 21. The two grooves defined between the ribs 21 accommodate windings 22 and it is arranged that the direction of current flow in one winding is in the opposite direction to the current flow in the other winding. As a result when electric current is passed through the windings the ribs 21 will have opposite magnetic polarity. The ribs 19 are positioned off-centre relative to the grooves and as a result when the windings are energised the armature 16 will move so that the reluctance of the magnetic circuits defined by the ribs 19 and 21 is reduced. In the example the armature 16 will move upwardly.

The stator portion is hollow and mounts a coiled compression spring 23. This bears against an adjustable abutment 24 at its end remote from the valve member, the opposite end of the spring bearing against an abutment 25. The abutment 25 has a depression in its face presented to the portion 17 of the armature which depression serves to locate the rounded end of the valve member 12.

Ignoring for the moment the remaining components shown in FIG. 1, the force exerted by the spring 23 is sufficient to maintain the valve member in the closed position so that no fuel can flow through the outlet orifices 13. When the windings 22 are energised the armature moves upwardly and the portion 17 of the armature engages with the abutment 25 to reduce the force exerted by the spring on the valve member. The valve member is of course subjected to a force created by the pressure of fuel acting on the aforesaid surface and the reduction in the force exerted by the spring upon energisation of the windings, is sufficient to allow the valve member to lift thereby to permit fuel to flow from the inlet 14 to the outlet orifices 13.

When the windings are de-energised the full spring force is available to move the valve member onto its seating and the flow of fuel through the outlet orifices ceases. The spring 23 also returns the armature 16 to its original position and in so doing the armature gains a considerable amount of energy. Impact loading of the valve member by the armature is however avoided since the armature can continue to move after the valve member has engaged with its seating. The extent of such movement is determined by a shim 26 located against the base wall of the chamber. It is desirable however, to damp the movement of the armature after the valve member has moved into contact with the seating and this damping is achieved by friction means which may come into play as soon as there is any tendency for the portion 17 of the armature to separate from the abutment 25 or the friction means may come into play after a small seperation of the parts has occurred.

Referring again to FIG. 1, the spring abutment 25 forms one part of the friction mechanism and for this purpose the abutment 25 is of cup shaped form. The outer surface of the skirt portion is tapered in the direction away from the valve member. Moreover, for co-operation with this surface there is provided a plurality of complementarily tapered segments 27. The segments are radially movable in a space defined between the inner surface of the base portion 17 of the armature and an inwardly extending flange 28 which is formed on an annular insert 29 which is located within the armature and which is provided with a threaded peripheral surface to enable it to be inserted into the armature. Conveniently the pin 18 also serves to retain the insert 29 against movement. The aforesaid segments are surrounded by a garter spring 30 so that the tapered surfaces on the segments and the spring abutment are held in engagement with each other. The flange 28 is provided with a central aperture through which the spring 23 can extend without interference.

In operation as soon as the spring abutment 25 and the base portion 27 of the armature start to separate following engagement of the valve member with its seating, the aforesaid tapered surfaces will coact to urge the segments outwardly against the action of the garter spring. During such movement the tapered surfaces move relative to each other, such movement resulting in fricton loss. In addition, there will be friction loss between the segments and the surfaces of the flange and base wall of the armature. The friction loss absorbs the energy in the armature and whilst the valve member is still utilised to bring the armature to rest, the impact loading of the valve member on its seating is minimised.

The segments free the next time the windings are energised because if a gap exists between the abutment 25 and the base wall of the armature 17, then the force developed on the armature will be transmitted to the abutment 25 through the friction forces between the tapering surfaces of the abutment and the aforesaid segments. In this design the upward movement of the armature is limited by the abutment of the ribs 19 and 21 and this will also serve to limit the upward movement of the valve member.

Referring now to FIG. 2 an additional part namely a rod 31 is provided and this is mounted on the spring abutment 24 for engagement with the spring abutment 25. A small clearance is defined in the rest position as shown in the drawing, between the end of the rod 31 and the spring abutment. The rod 31 acts to limit the upward movement of the spring abutment 25 and therefore the upward movement of the valve member 12. If after the windings are energised, the base portion 17 of the armature does not come into contact with the abutment 25 then the abutment 25 will be lifted but during this movement it will suddenly be brought to rest by its engagement with the end of the rod 31. The continued force generated by the magnetic field and also the inertia of the armature will assist in freeing the tapered surfaces of the spring abutment 25 and the segments 27. In this example the upward movement of the armature is of course limited by the abutment of the portion 17 of the armature with the spring abutment 25.

In this example the force which is exerted by the spring 23 is adjusted by means of shims 32 disposed between the spring and the abutment 24. The position of the abutment 24 is adjustable for the purpose of determining the gap between the end of the rod 31 and the spring abutment 25. In the example of FIG. 1 the abutment 24 is adjustable purely for the purpose of determining the force exerted by the spring 23.

In both examples described damping of the movement of the armature takes place as soon as the valve member contacts the seating. It is possible to arrange that the damping of the movement of the armature does not take place until after the valve member 12 has moved into contact with the seating. This is achieved by ensuring that a clearance is provided between the flange 28 and the segments 27. This clearance allows continued and unhindered movement of the armature after the valve member has engaged its seating. Moreover, in the event that the valve member should bounce from its seating the continuing movement of the armature will assist through the friction means, the spring 23 to urge the valve member back onto its seating.

I claim:

1. A liquid fuel injection nozzle of the kind intended to be mounted on an internal combustion engine and through which liquid fuel can be supplied to an engine, the nozzle, comprising a body part, a seating defined in the body part, a valve member shaped for co-operation with said seating, resilient means biasing the valve member into contact with the seating to prevent the flow of liquid fuel through an outlet from an inlet, electromagnetic means which when energised, acts to reduce the force exerted by the resilient means on said valve member so that the valve member can move away from the seating under the action of fuel pressure to permit flow of fuel from the inlet to the outlet, an abutment member engaging the valve member and through which the force exerted by the resilient means acts on the said valve member, an armature forming part of said electromagnetic means, the armature including a portion engageable against said abutment member on the side thereof adjacent the valve member whereby when the electromagnetic means is energised said portion of the armature will engage said abutment member to reduce the force exerted by the resilient means on the valve member and when the electromagnetic means is de-energised the portion of the armature can separate from the abutment member, and friction means operable during separation of said portion of the armature from the abutment member to absorb the energy gained by the armature during its movement under the action of said resilient means.

2. A nozzle according to claim 1 in which said friction means acts between the armature and the abutment member.

3. A nozzle according to claim 2 in which said friction means comprises a plurality of elements carried by the armature, each of said elements defining a surface for engagement with a surface of said abutment member, resilient means urging the surfaces defined by said elements into contact with said surface of the abutment member said surfaces being arranged so that during the relative movement of the armature and the abutment member the contacting surfaces of said elements and said abutment member will move relative to each other thereby providing a friction loss.

4. A nozzle according to claim 3 in which said abutment member has a tapered cylindrical outer surface and the surfaces of said elements are of complementary shape.

5. A nozzle according to claim 4 in which said elements are in the form of segments surrounding said abutment member, said resilient means comprising a garter spring which extends around said segments.

6. A nozzle according to claim 5 in which said portion of the armature is of cup shaped form, said portion of the armature being defined by the base wall of the armature, an insert located in the armature and defining an inwardly extending flange, said segments being located intermediate the flange and the base wall of the armature whereby radial movement of the segments can take place during relative movement of the armature and abutment member.

7. A nozzle according to claim 6 in which the base wall of the armature is provided with an aperture through which extends a part of the valve member which engages said abutment member.

8. A nozzle according to claim 6 in which the distance between said flange and said base wall is greater than the axial length of said segments whereby said friction means does not act until after the valve member has contacted the seating.

9. A nozzle according to claim 6 including stop means for limiting the movement of the armature upon energisation of the electromagnetic means.

10. A nozzle according to claim 9 in which said stop means comprises surfaces defined on the armature and on a stator forming part of the electromagnetic device.

11. A nozzle according to claim 9 in which said stop means comprises a stop member engageable by said abutment member.

* * * * *